US011358163B2

(12) United States Patent
Vasquez et al.

(10) Patent No.: US 11,358,163 B2
(45) Date of Patent: Jun. 14, 2022

(54) FAN ATTACHMENT TO DISPOSABLE CONTAINERS AND MEANS FOR ATTACHMENT

(71) Applicants: Robert Vasquez, Gilbert, AZ (US); Brian Freeland, Chandler, AZ (US)

(72) Inventors: Robert Vasquez, Gilbert, AZ (US); Brian Freeland, Chandler, AZ (US)

(73) Assignee: SHAWSHANK LEDZ INC., Gilbert, AZ (US)

( * ) Notice: Subject to any disclaimer, the term of this patent is extended or adjusted under 35 U.S.C. 154(b) by 372 days.

(21) Appl. No.: 16/533,793

(22) Filed: Aug. 7, 2019

(65) Prior Publication Data

US 2021/0039120 A1 Feb. 11, 2021

(51) Int. Cl.

| | |
|---|---|
| ***B05B 7/00*** | (2006.01) |
| ***A47F 3/04*** | (2006.01) |
| ***A47F 7/00*** | (2006.01) |
| *G09F 23/06* | (2006.01) |

(52) U.S. Cl.

CPC ..... *B05B 7/0081* (2013.01); *A47F 3/0434* (2013.01); *A47F 3/0486* (2013.01); *A47F 7/00* (2013.01); *G09F 23/06* (2013.01)

(58) Field of Classification Search

CPC ..... F04D 25/088; F04D 25/0693; F04D 25/0673; F04D 25/084; F04D 29/601; D06F 58/00; D06F 59/02; A47G 25/28; A47G 25/0692; B05B 7/0081; B05B 3/022; B05B 3/02; B05B 9/0861; A47F 3/0434; A47F 7/00; A47F 3/0486; G09F 23/06; B01F 3/04056

See application file for complete search history.

(56) References Cited

U.S. PATENT DOCUMENTS

| | | | | |
|---|---|---|---|---|
| 2,872,060 A * | 2/1959 | Brune | B65D 39/0029 215/364 |
| 4,235,377 A | 11/1980 | Davis et al. | |
| 4,993,639 A | 2/1991 | Hata et al. | |
| 5,323,517 A * | 6/1994 | Su | A61J 11/04 24/20 EE |
| 5,338,495 A * | 8/1994 | Steiner | F24F 5/0035 261/28 |

(Continued)

FOREIGN PATENT DOCUMENTS

| | | |
|---|---|---|
| CN | 201425031 Y | 3/2010 |
| KR | 100272973 B1 | 8/2000 |
| WO | 2004048211 A2 | 6/2004 |

*Primary Examiner* — Ko H Chan

(74) *Attorney, Agent, or Firm* — LegalForce RAPC Worldwide

(57) ABSTRACT

Disclosed are a method and/or a system of a fan attachment to disposable containers and a means for attachment of the fan to disposable containers. An adaptable spray fan includes a disposable container section formed of a polyethylene material to hold a potable liquid and a reusable fan apparatus coupled to the disposable container section. The reusable fan apparatus is coupled to the disposable container section through an adjustable coupling mechanism of the reusable fan apparatus and/or a separate attachment coupleable with the reusable fan apparatus. The adjustable coupling mechanism and/or separate attachment secure reusable fan apparatus to the disposable container section at an opening of the disposable container section.

20 Claims, 6 Drawing Sheets

(56) References Cited

U.S. PATENT DOCUMENTS

| | | | | |
|---|---|---|---|---|
| 5,667,731 | A * | 9/1997 | Junkel | B01F 3/04035 239/289 |
| 5,740,948 | A | 4/1998 | Chu et al. | |
| 5,965,067 | A | 10/1999 | Junkel et al. | |
| 6,161,777 | A | 12/2000 | Carter et al. | |
| 6,398,132 | B1 | 6/2002 | Junkel et al. | |
| 6,499,615 | B1 * | 12/2002 | Szieff | A61J 9/00 215/11.1 |
| 7,143,958 | B1 | 12/2006 | Dorney | |
| 7,198,080 | B2 * | 4/2007 | Foust | B65D 71/502 141/319 |
| 7,775,848 | B1 * | 8/2010 | Auerbach | F04D 19/002 446/73 |
| 8,031,073 | B2 * | 10/2011 | Hogan | E05B 73/0052 340/572.9 |
| 8,205,806 | B2 | 6/2012 | Mak et al. | |
| 8,763,831 | B2 * | 7/2014 | Garcia | B65D 47/0842 215/355 |
| 9,339,827 | B2 * | 5/2016 | Chan | B05B 3/02 |
| 9,881,528 | B2 * | 1/2018 | Dunn | G09F 9/35 |
| 10,244,873 | B2 * | 4/2019 | Brenner | A47F 3/0434 |
| 10,294,012 | B2 * | 5/2019 | Mo | B65D 83/14 |
| 10,800,580 | B2 * | 10/2020 | Cao | B65D 41/0485 |
| 2002/0148909 | A1 | 10/2002 | Junkel et al. | |
| 2004/0067091 | A1 * | 4/2004 | Tsutsumi | A45D 34/045 401/127 |
| 2006/0254299 | A1 | 11/2006 | Lau | |
| 2008/0006718 | A1 | 1/2008 | Junkel et al. | |
| 2008/0093476 | A1 | 4/2008 | Johnson et al. | |

* cited by examiner

FAN ATTACHMENT TO DISPOSABLE CONTAINERS AND MEANS FOR ATTACHMENT

FIELD OF TECHNOLOGY

This disclosure relates generally to misting fan devices and, more particularly, to a method and/or a system of a fan attachment to disposable containers and a means for attachment of the fan to disposable containers.

BACKGROUND

A bottle may be designed as a disposable drinking container to store a potable liquid (e.g., water, flavored water, sparkling water, juices, soft drinks). There may be a great variety in the types of disposable drinking containers sold on retail shelves. For example, disposable drinking containers may be marketed in various shapes and/or form factors. Different types of disposable drinking containers may have varying sized openings, with a wide range of threading patterns on which a cap and/or a liquid dispensing mechanism may be affixed. Disposable drinking containers may be pre-packaged with potable liquids and sold through point of sale displays at retail stores (e.g., a convenience store, a gas station, a grocery store).

The disposable drinking containers with potable liquid sold in the retail stores may be used by the people traveling long distances, away from home, to hydrate themselves while traveling. Additionally, the travellers may need to use these disposable drinking containers as a source for cooling during their journey. The travellers may couple these disposable drinking containers to a misting fan to create a current of cool air by misting water through it. The travellers may not have appropriate connecting means to couple a readily available disposable drinking container to the misting fan they may be carrying, making it unusable and thus leaving them suffer in hot weather.

For example, during the summer season, people may go on long road trips for vacations and/or camping in a warm place. When in warm places, people may use portable misting fan for cooling themselves and/or spray their faces with clean water. For this, people may need to carry bulky bottles couplable to the misting fan in addition to the misting fan, making it cumbersome while on a road trip. The bulky bottles may not be useful once the water in it has been fully consumed, making it difficult for them to replace it with another one couplable to the misting fan available.

SUMMARY

Disclosed are a method and/or a system of a fan attachment to disposable containers and a means for attachment of the fan to the disposable containers.

In one aspect, an adaptable spray fan includes a disposable container section formed of a polyethylene material to hold a potable liquid and a reusable fan apparatus coupled to the disposable container section. The reusable fan apparatus is coupled to the disposable container section through an adjustable coupling mechanism of the reusable fan apparatus and/or a separate attachment coupleable with the reusable fan apparatus. The adjustable coupling mechanism and/or separate attachment is configured to secure the reusable fan apparatus to the disposable container section at an opening of the disposable container section.

The reusable fan apparatus may include a calibration means to modify a size of the adjustable coupling mechanism to fasten with the opening of the disposable container section. The opening of the disposable container section may be circular having a dimension between approximately ½ an inch and/or approximately 2 inches in diameter. The adjustable coupling mechanism of the reusable fan apparatus may include a one-click lock design to squeezably secure the reusable fan apparatus onto the opening of the disposable container section.

The separate attachment coupleable with the reusable fan apparatus may include a plurality of adapters to secure the reusable fan apparatus to the opening of the disposable container section through a set of male threaded end at a top portion of the adapter releasably engaged to a set of interrelated female threads at a bottom portion of the reusable fan apparatus.

The reusable fan apparatus may be configured such that the reusable fan apparatus remains upright when mounted on a small disposable water bottle. The reusable fan apparatus may include a set of batteries in a battery enclosure to activate a motor assembly coupled to the fan to provide a misting of the potable liquid. The disposable container section engaged to the reusable fan apparatus may be easily positionable on a water bottle holder of an automobile for usage while driving. The separate attachment coupleable with the reusable fan apparatus may be configured to use an adaptor based on the size of the opening of the container.

In another aspect, a refrigerated merchandiser includes a plurality of shelves to store a number of disposable liquid containers. The refrigerated merchandiser further includes a transparent door through which the number of disposable liquid containers are viewable to customers at a retail store. In addition, refrigerated merchandiser includes a set of reusable fan apparatuses advertised on a front face of the transparent door. The set of reusable fan apparatuses are coupleable with some of the disposable liquid containers stored in the shelves of the refrigerated merchandiser. Each reusable fan of the set of reusable fan apparatus is designed such that they are connectable to the disposable liquid containers through an adjustable coupling mechanism. The adjustable coupling mechanism and/or a separate attachment coupleable with the each reusable fan apparatus secures each reusable fan apparatus at an opening of the disposable liquid containers displayed in the refrigerated merchandiser.

In yet another aspect, a modular attachment to fasten a reusable fan apparatus to a disposable container includes a coupling mechanism and/or a calibrating mechanism. The coupling mechanism securely engages the reusable fan apparatus to the disposable container. The calibrating mechanism modifies a size of the modular attachment to fasten the reusable fan apparatus to the disposable container.

The modular attachment may include a plurality of adaptors to enable the reusable fan apparatus to fasten to the disposable container having an opening of approximately ½ an inch to 2 inches in diameter. The calibrating mechanism may include a locking means to fixedly attach the reusable fan apparatus onto the disposable container by manipulating the calibrating mechanism of the modular attachment.

The reusable fan apparatus may be configured such that the thin polyethylene material walls of the disposable container remain non-collapsible when attached to the reusable fan apparatus. The reusable fan apparatus may be easily removable from the disposable container.

The modular attachment of the reusable fan apparatus may be configured such that the reusable fan apparatus remains upright when mounted on a small disposable water bottle using the modular attachment. The disposable container engaged to the reusable fan apparatus may be easily positionable on a water bottle holder of an automobile for usage while driving. The reusable fan apparatus may be configured such that the thin polyethylene material walls of the disposable container remains non-collapsible when attached to the reusable fan apparatus.

The methods and systems disclosed herein may be implemented in any means for achieving various aspects, and may be executed by a machine, cause the machine to perform any of the operations disclosed herein. Other features will be apparent from the accompanying drawings and from the detailed description that follows.

BRIEF DESCRIPTION OF THE DRAWINGS

The embodiments of this invention are illustrated by way of example and not limitation in the figures of the accompanying drawings, in which like references indicate similar elements and in which.

Figure 1:
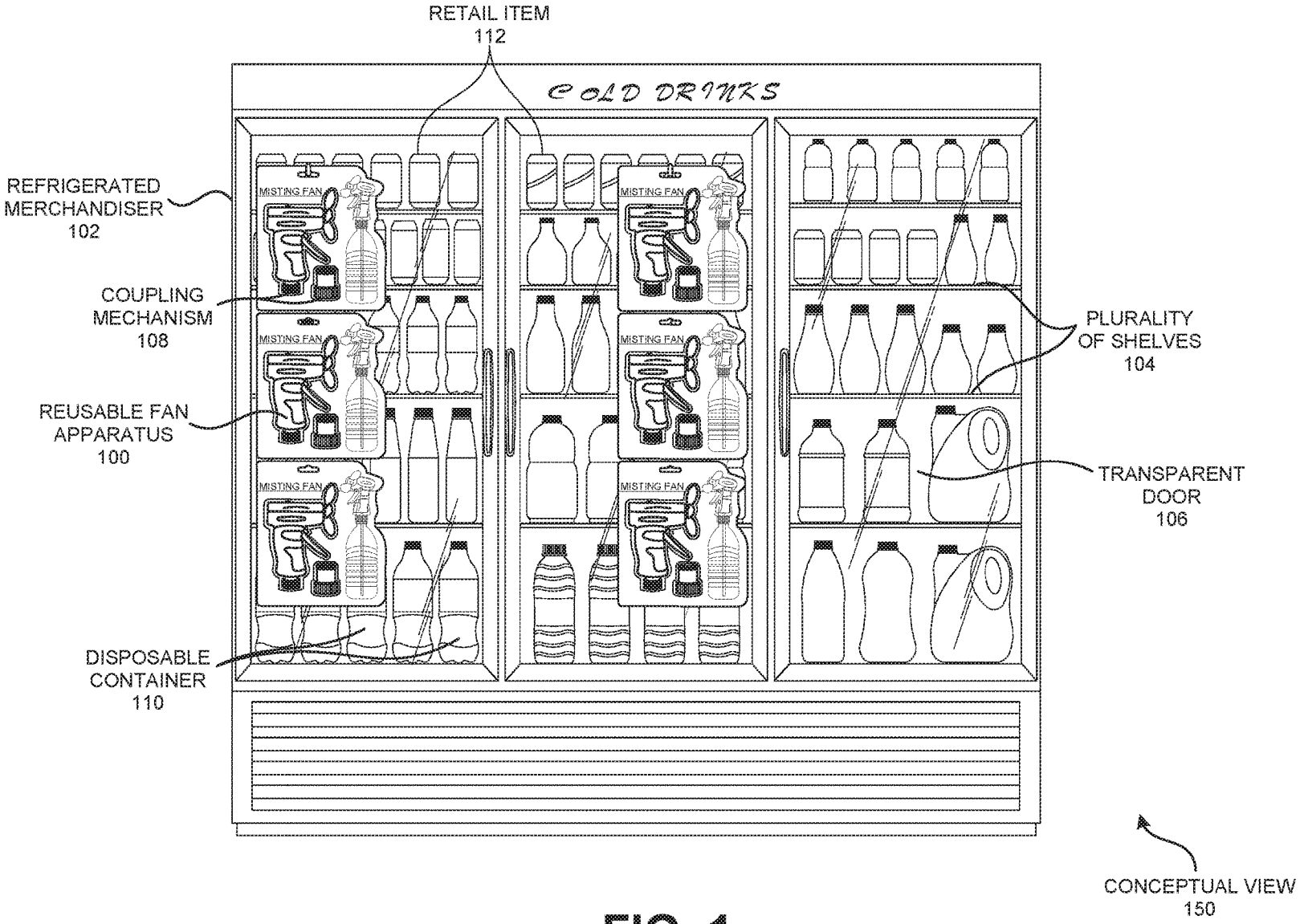
FIG. 1 is a conceptual view illustrating a refrigerated merchandiser exhibiting a set of reusable fan apparatuses, advertised on a front face of the transparent door of the refrigerated merchandiser, designed to be releasably coupled to a disposable container displayed in a plurality of shelves of the refrigerated merchandiser through a coupling mechanism, according to one embodiment.

Other features of the present embodiments will be apparent from the accompanying drawings and from the detailed description that follows.

DETAILED DESCRIPTION

Example embodiments, as described below, may be used to provide a method, a system and/or a device of a fan attachment to disposable containers and a means for attachment of the fan to disposable containers.

In one embodiment, an adaptable spray fan (e.g., using the reusable fan apparatus 100) includes a disposable container section 214 formed of a polyethylene material to hold a potable liquid and a reusable fan apparatus 100 coupled to the disposable container section 214. The reusable fan apparatus 100 is coupled to the disposable container section 214 through an adjustable coupling mechanism 402 of the reusable fan apparatus 100 and/or a separate attachment (e.g., coupling mechanism 108) coupleable with the reusable fan apparatus 100. The adjustable coupling mechanism 402 and/or separate attachment (e.g., coupling mechanism 108, plurality of adaptors 218) are configured to secure the reusable fan apparatus 100 to the disposable container section 214 at an opening 312 of the disposable container section 214.

The reusable fan apparatus 100 may include a calibration means 404 to modify a size of the adjustable coupling mechanism 402 to fasten with the opening 312 of the disposable container section. The opening 312 of the disposable container section 214 may be circular having a dimension between approximately ½ an inch and/or approximately 2 inches in diameter. The adjustable coupling mechanism 402 of the reusable fan apparatus 100 may further include a one-click lock 406 design to squeezably secure the reusable fan apparatus 100 onto the opening 312 of the disposable container section 214.

The separate attachment (e.g., coupling mechanism 108) coupleable with the reusable fan apparatus 100 may include a plurality of adapters 218 to secure the reusable fan apparatus 100 to the opening 312 of the disposable container section 214 through a set of male threaded end (e.g., first set of male threads 304) at a top portion of the adapter (e.g., plurality of adaptors 218) releasably engaged to a set of interrelated female threads 302 at a bottom portion of the reusable fan apparatus 100.

The reusable fan apparatus 100 may be configured such that the reusable fan apparatus 100 remains upright when mounted on a small disposable water bottle (e.g., disposable container 110). The reusable fan apparatus 100 may include a set of batteries in a battery enclosure to activate a motor assembly coupled to the fan 204 to provide a misting of water droplets. The disposable container section 214 engaged to the reusable fan apparatus 100 may be easily positionable on a water bottle holder of an automobile for usage while driving. The separate attachment (e.g., coupling mechanism 108) coupleable with the reusable fan apparatus 100 may be configured to use an adaptor (e.g., plurality of adaptors 218) based on the size of the opening 312 of the container (e.g., disposable container 110).

In another embodiment, a refrigerated merchandiser 102 includes a plurality of shelves 104 to store a number of disposable liquid containers (e.g., disposable container 110). The refrigerated merchandiser 102 further includes a transparent door 106 through which the number of disposable liquid containers (e.g., disposable container 110) are viewable to customers (e.g., user 502) at a retail store. In addition, refrigerated merchandiser 102 includes a set of reusable fan apparatuses 100 advertised on a front face of the transparent door 106. The set of reusable fan apparatuses 100 are coupleable with some of the disposable liquid containers (e.g., disposable container 110) stored in the plurality of shelves 104 of the refrigerated merchandiser 102. Each reusable fan of the set of reusable fan apparatus 100 is designed such that they are connectable to the disposable liquid containers (e.g., disposable container 110). The disposable liquid container (e.g., disposable container 110) is connectable to the reusable fan apparatus 100 through an adjustable coupling mechanism 402 and/or a separate attachment (e.g., coupling mechanism 108) coupleable with each reusable fan apparatus to secure each reusable fan apparatus 100 at an opening 312 of the disposable liquid containers (e.g., disposable container 110).

In yet another embodiment, a modular attachment to fasten a reusable fan apparatus 100 to a disposable container 110 includes a coupling mechanism 108 and a calibrating mechanism (e.g., using calibration means 404). The coupling mechanism 108 securely engages the reusable fan apparatus 100 to the disposable container 110 and the calibrating mechanism (e.g., using calibration means 404) modifies a size of the modular attachment to fasten the reusable fan apparatus 100 to the disposable container 110.

The modular attachment may include a plurality of adaptors 218 to enable the reusable fan apparatus 100 to fasten to the disposable container 110 having an opening 312 of approximately ½ an inch to 2 inches in diameter. The calibrating mechanism (e.g., using calibration means 404) may include a locking means (e.g., one-click lock 406) to fixedly attach the reusable fan apparatus 100 onto the disposable container 110 by manipulating the calibrating mechanism (e.g., using calibration means 404) of the modular attachment (e.g., adjustable coupling mechanism 402).

The reusable fan apparatus 100 may be configured such that the thin polyethylene material walls of the disposable container 110 remain non-collapsible when attached to the reusable fan apparatus 100. The reusable fan apparatus 100 may be easily removable from the disposable container 110.

The modular attachment (e.g., adjustable coupling mechanism 402) of the reusable fan apparatus 100 may be configured such that the reusable fan apparatus 100 remains upright when mounted on a small disposable water bottle using the modular attachment. The disposable container 110 engaged to the reusable fan apparatus 100 may be easily positionable on a water bottle holder of an automobile for usage while driving. The reusable fan apparatus 100 may be configured such that the thin polyethylene material walls of the disposable container 110 remains non-collapsible when attached to the reusable fan apparatus 100.

FIG. 1 is a conceptual view 150 illustrating a refrigerated merchandiser 102 exhibiting a set of reusable fan apparatuses 100, advertised on a front face of the transparent door 106 of the refrigerated merchandiser 102, designed, to be releasably coupled to a disposable container 110 displayed in plurality of shelves 104 of the refrigerated merchandiser through a coupling mechanism 108, according to one embodiment. Particularly, FIG. 1 illustrates a reusable fan apparatus 100, a refrigerated merchandiser 102, a plurality of shelves 104, a transparent door 106, a coupling mechanism 108, a disposable container 110, and a retail item 112, according to one embodiment.

The reusable fan apparatus 100 may be an appliance coupled to a disposable container to provide a mass of fine droplets of potable liquid (e.g., water) at a rear of a fan 204 so as to create a current of moist air for providing personal comfort to a user 502 when the reusable fan apparatus 100 is switched ON. The reusable fan apparatus 100 may be designed to combine a blower fan (e.g., fan 204) with a high-pressure water pump. The potable liquid (e.g., water) may be blown through the misting nozzle 212 and/or a centrifugal misting system, producing a fog of potable liquid (e.g., water) droplets.

The reusable fan apparatus 100 may be coupled to a disposable container 110 to help generate tiny droplets of water and produce a current of moist air. The reusable fan apparatus 100 may include a misting head 202 attached to the outer frame of the fan 204. The water blown out from the misting nozzle 212 may produce the mist which quickly evaporates resulting in cooler air blowing out of the fan 204. The reusable fan apparatus 100 may be connectively coupled to a disposable container 110 having potable liquid through the coupling mechanism 108. The reusable fan apparatus 100 may be designed to be reused by coupling it to another disposable container 110 once the potable liquid in one of the disposable container 110 is consumed.

The refrigerated merchandiser 102 may be a retail display cabinet designed to display and retail frozen and refrigerated food and/or beverages. The refrigerated merchandiser 102 may enable customers to view the contents stored in the cabinet (e.g., reusable fan apparatus 100, disposable container 110 etc.) through its transparent door 106. The refrigerated merchandiser 102 may serve as the reason to attract the consumer attention to refrigerated food and/or beverage products (e.g., new products in the market, special offers, discounts, weekend offers, etc.). The refrigerated merchandiser 102 may be aimed at influencing the purchasing behavior of a consumer to buy the reusable fan apparatus 100 and/or the disposable container 110. A set of reusable fan apparatuses 100 may be advertised on a front face of the transparent door 106 of the refrigerated merchandiser 102.

The plurality of shelves 104 may be a number of racks of the refrigerated merchandiser 102 exhibiting the item of sales (e.g., disposable container 110 etc.).

The coupling mechanism 108 may be a tool to releasably attach the reusable fan apparatus 100 to an opening 312 of a disposable container 110. The coupling mechanism 108 may be the adjustable coupling mechanism 402 of the reusable fan apparatus 100 and/or a separate attachment (e.g., plurality of adaptors 218) of the reusable fan apparatus 100 connectively couplable with the disposable container 110.

The coupling mechanism 108 may include a number of adaptors 218A, 218B, 218C to couple the opening 312 of the disposable container 110 (e.g., water bottle, disposable container 602A, 602B, 602C) of variable sizes to the reusable fan apparatus 100. The adaptors 218A, 218B, 218C may be used based on the size of opening 604A, 604B, 604C of the disposable container 110.

The disposable container 110 may be a one-use can and/or a vessel to hold retail items such as potable liquid and/or food. The disposable container 110 may be discarded once the potable liquid and/or food contained in the disposable container 110 is consumed. The disposable container 110 may be connectively coupled to the reusable fan apparatus 100 to function as a misting device. The disposable container 110 may be readily available to a user at a retail store.

The retail item 112 may be a good and/or product of sale for use and/or consumption of an individual consumer. The retail item 112 may include a grocery items, cold drinks, water bottle, juices, etc.

Figure 2:
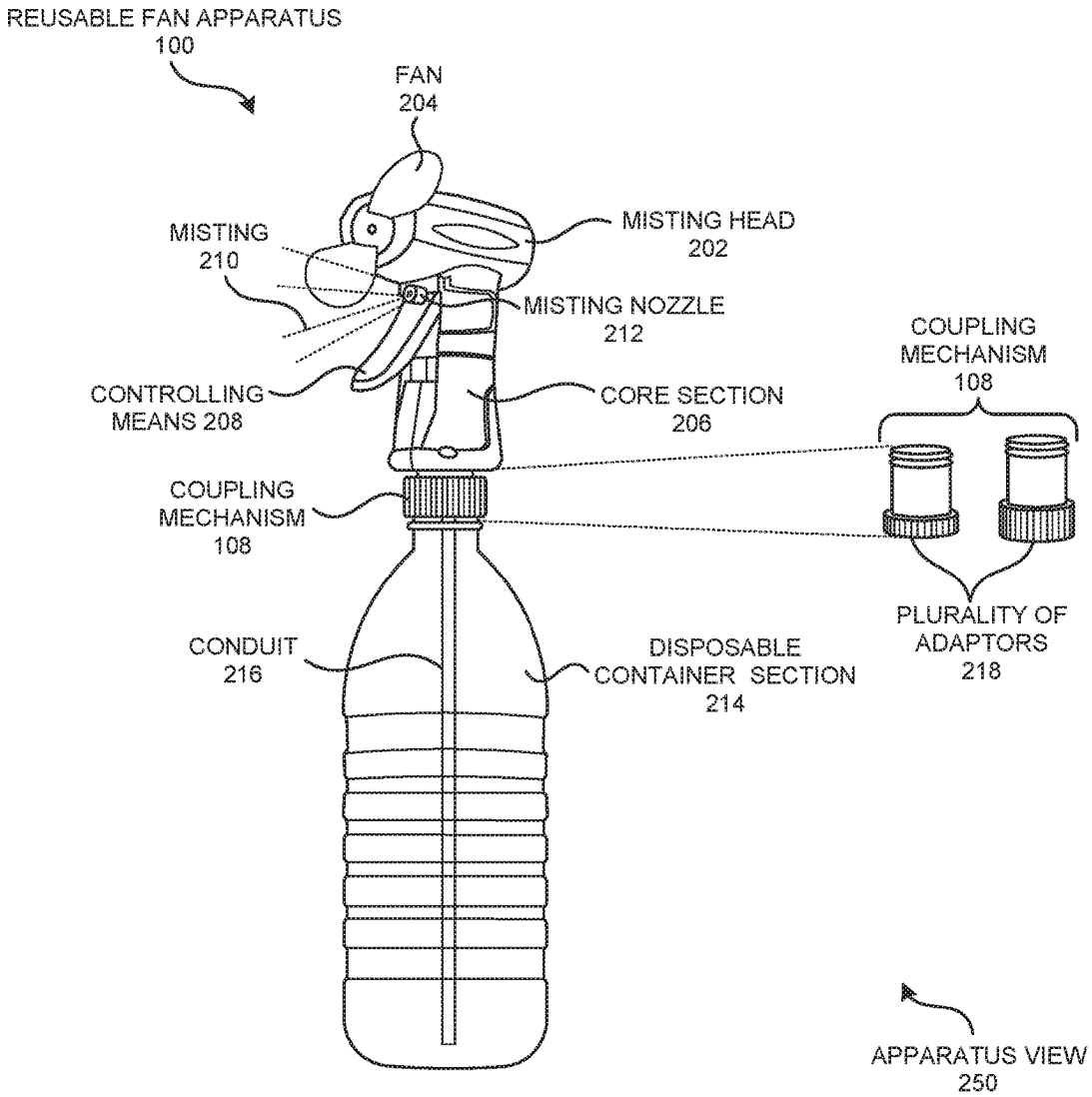
FIG. 2 is an apparatus view illustrating a reusable fan apparatus of FIG. 1 connectively coupled with a disposable container through a coupling mechanism of the reusable fan apparatus to generate a mist of liquid using the reusable fan apparatus, according to one embodiment.

FIG. 2 is an apparatus view 250 illustrating a reusable fan apparatus 100 of FIG. 1 connectively coupled with the disposable container 110 through a coupling mechanism 108 of the reusable fan apparatus 100 to generate a mist of liquid using the reusable fan apparatus 100, according to one embodiment.

Particularly, FIG. 2 builds on FIG. 1, and further adds, a misting head 202, a fan 204, a core section 206, a controlling means 208, misting 210, a misting nozzle 212, a disposable container section 214, a conduit 216, and a plurality of adaptors 218, according to one embodiment.

The misting head 202 may be a hollow space formed at the top portion of the reusable fan apparatus 100 to hold the motor assembly of the reusable fan apparatus 100. The misting head 202 may include a fan 204, a misting nozzle 212, and a controlling means 208 at a front portion of the reusable fan apparatus 100 to operate the reusable fan apparatus 100.

The fan 204 may be an equipment having a set of rotating blades to create a current of air for cooling and/or ventilation. The fan 204 may be connected to the motor assembly installed in the misting head 202 of the reusable fan apparatus 100. The fan 204 may be switched ON/OFF by pressing a button provided at the top portion of the misting head 202.

The core section 206 may be the central portion of the reusable fan apparatus 100 forming an interior cavity to enable a conduit 216 to move the water and/or potable liquid from the disposable container section 214 to the misting head 202 to expel it from the misting nozzle 212 provided at a front portion of the reusable fan apparatus 100. The core section 206 may be moulded such that it may be held tightly by a user when using the reusable fan apparatus 100.

The controlling means 208 may be a mechanism to operate a pump to draw water from the disposable container section 214 to expel it from the misting nozzle 212 provided at the front portion of the core section 206 of the reusable fan apparatus 100. According to one embodiment, the controlling means 208 may be a lever to operate a pump of the reusable fan apparatus 100.

The disposable container section 214 may be a segment of the disposable container 110 holding the potable liquid (e.g., water). The disposable container section 214 may be connected to the core section 206 of the reusable fan apparatus 100 through the coupling mechanism 108. The misting 210 may be the process of spraying water from the disposable container 110 connectively coupled to the reusable fan apparatus 100 to create a fine cloud of water droplets for providing personal cooling using the reusable fan apparatus 100.

The conduit 216 may be a tube and/or a channel provided to move water and/or potable liquid drawn from the disposable container section 214 to the core section 206 of the reusable fan apparatus 100 to expel it from the misting nozzle 212. The plurality of adaptors 218 may be a set of coupling means provided to releasably attach the reusable fan apparatus 100 to an opening of a disposable container 110 (e.g., a water bottle, disposable container 602A, 602B, 602C) to create a current of moist, cool air when the reusable fan apparatus 100 is operated. The plurality of adaptors 218 may enable a user 502 to attach a readily available water bottle having a variable opening size (e.g., opening 604A, 604B, 604C) to the reusable fan apparatus 100 to get cool air.

Figure 3:
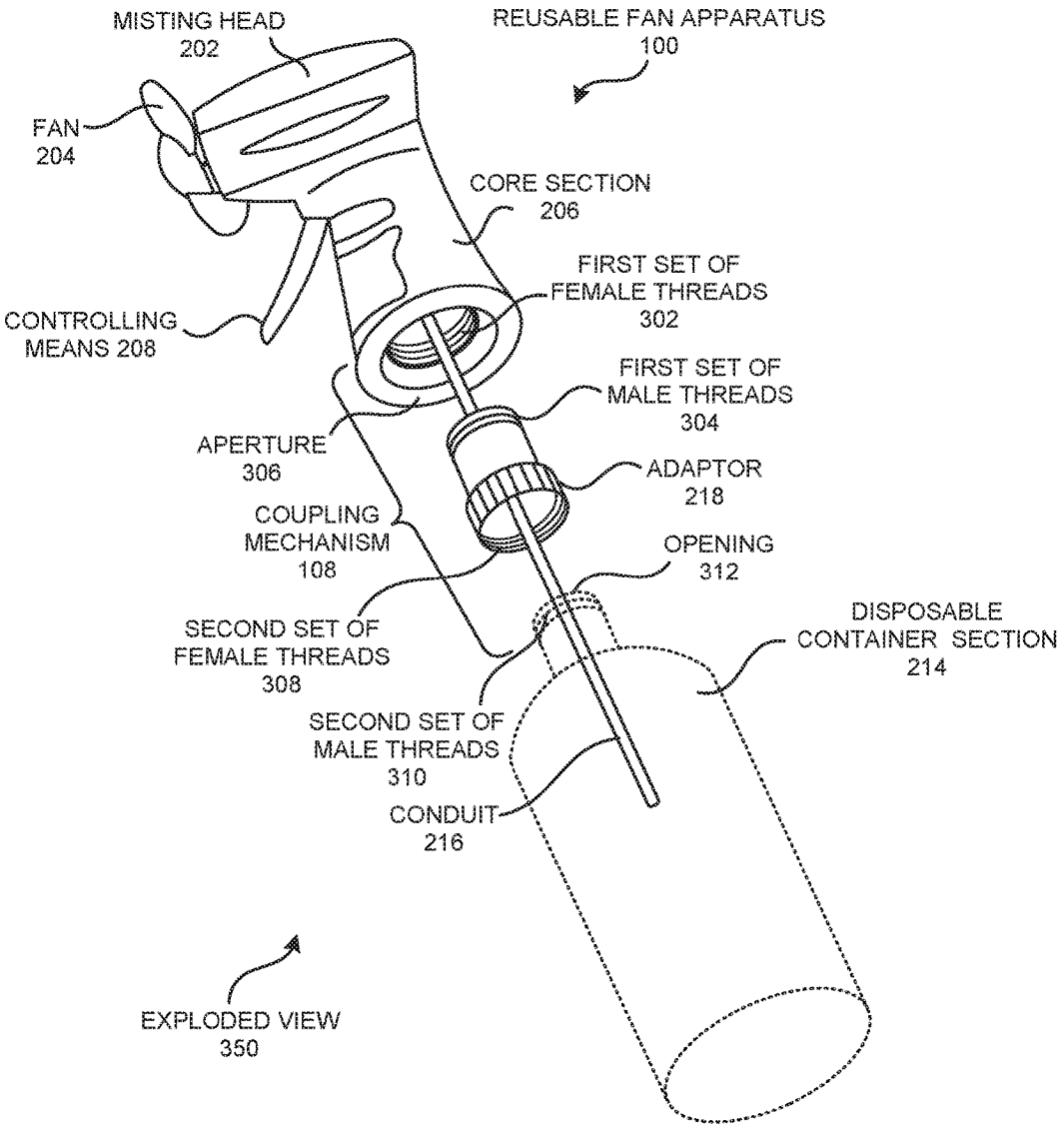
FIG. 3 is an exploded view of the reusable fan apparatus of FIG. 1 illustrating the various components of the coupling mechanism to enable the reusable fan apparatus to be coupled to the disposable container, according to one embodiment.

FIG. 3 is an exploded view 350 of the reusable fan apparatus 100 of FIG. 1 illustrating the various components of the coupling mechanism 108 to enable the reusable fan apparatus 100 to be coupled to a disposable container section 214, according to one embodiment. Particularly, FIG. 3 builds on FIGS. 1 and 2, and further adds, an aperture 306, first set of female threads 302, a male threads 304, and an opening 312, according to one embodiment.

The aperture 306 may be an opening and/or opening at the bottom portion of the core section 206 to enable the adaptor 218 to attach the disposable container section 214 to the reusable fan apparatus 100. The aperture 306 may include the set of interrelated female threads (e.g., first set of female threads 302) at the inner portion of the reusable fan apparatus 100 to allow the adaptor 218 to attach to the reusable fan apparatus 100.

The female threads (e.g., first set of female threads 302) may be a set of helical grooves in a cylindrical adaptor at the aperture 306 of the core section 206. The female threads (e.g., first set of female threads 302, second set of female threads 308) may be designed to mate with preformed male threads (e.g., first set of male threads 304) of the adaptor 218 to lockingly engage the reusable fan apparatus 100 to the disposable container section 214.

The male threads (e.g., first set of male threads 304) may be a set of helical ridges in a cylindrical adaptor at the top portion of the adaptor 218. The male threads (e.g., first set of male threads 304) may be designed to mate with preformed first set of female threads 302 of the reusable fan apparatus 100 to lockingly engage the reusable fan apparatus 100 to the disposable container section 214. The opening 312 may be a mouth of the disposable container 110 through which the adaptor 218 is lockingly engaged to the reusable fan apparatus 100. The second set of female threads 308 at the bottom portion of the adaptor 218 may mate with the second set of male threads 310 at the opening of the disposable container 110 to connectively couple the disposable container 110 to the reusable fan apparatus 100.

Figure 4:
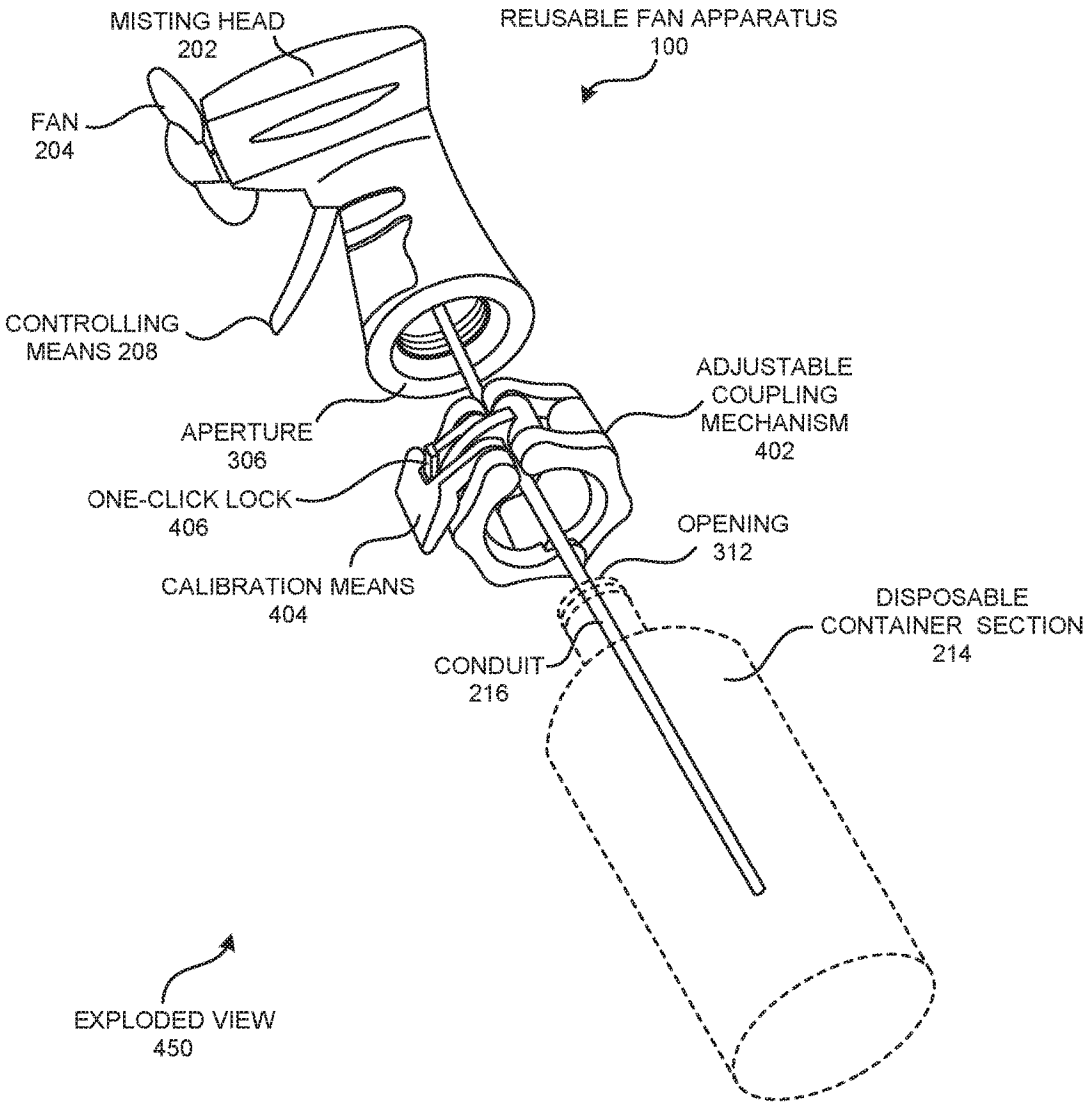
FIG. 4 is another exploded view of the reusable fan apparatus of FIG. 1, connectively coupled with the disposable container through an adjustable coupling mechanism of the reusable fan apparatus, according to one embodiment

FIG. 4 is another exploded view 450 of the reusable fan apparatus 100 of FIG. 1 illustrating a disposable container 110 connectively coupled with the reusable fan apparatus 100 through an adjustable coupling mechanism 402, according to one embodiment. Particularly, FIG. 4 builds on FIGS. 1-3, and further adds, an adjustable coupling mechanism 402, a calibration means 404, and a one-click lock 406, according to one embodiment.

The adjustable coupling mechanism 402 may be a tool and/or an implementation to fasten the reusable fan apparatus 100 onto the disposable container 110 by modifying the size of the adjustable coupling mechanism 402 according to the size of the opening 312 of the disposable container 110. The adjustable coupling mechanism 402 may include calibration means 404 to modify the size of the adjustable coupling mechanism 402 by manipulating its size. Further, a one-click lock 406 of the adjustable coupling mechanism 402 may be used to lockingly engage the reusable fan apparatus 100 onto the disposable container 110.

Figure 5:
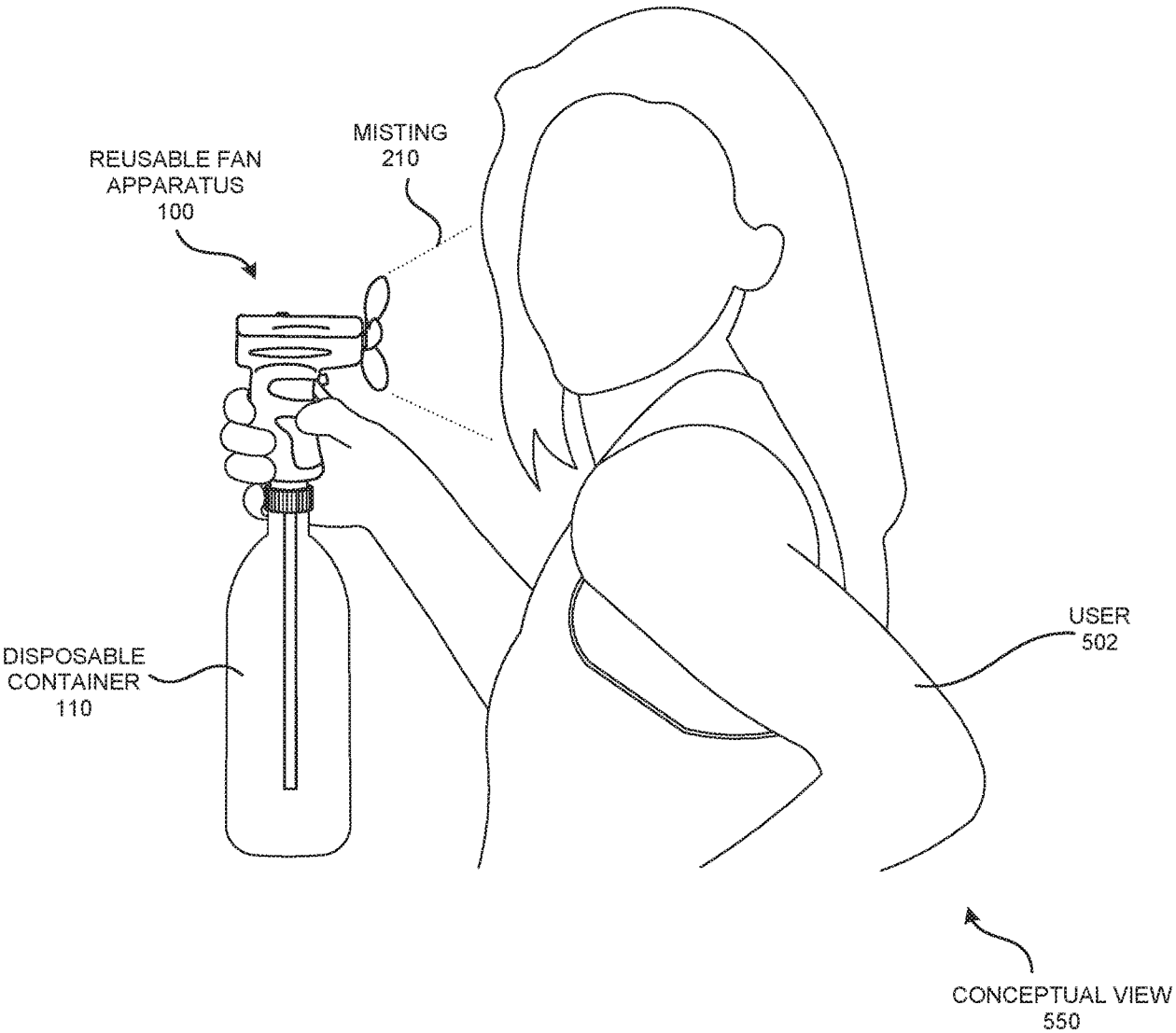
FIG. 5 is a conceptual view illustrating a misting of liquid droplets using the reusable fan apparatus of FIG. 1 connectively coupled with the water bottle by a user, according to one embodiment.

FIG. 5 is a conceptual view 550 illustrating a misting 210 of liquid droplets using the reusable fan apparatus 100 of FIG. 1 connectively coupled with the disposable container 110 by a user 502, according to one embodiment. The user 502 may convert a readily available disposable container 110 containing potable liquid into a misting device. The user 502 may lockingly engage the reusable fan apparatus 100 onto the disposable container 110 using the coupling mechanism 108. The user 502 may utilize the adjustable coupling mechanism 402 and/or an adaptor 218 to couple the reusable fan apparatus 100 onto the disposable container 110. The user 502 may use the controlling means 208 to pump the liquid from the disposable container section 214 to expel it from the misting nozzle 212 creating a mist of liquid droplets.

Figure 6:
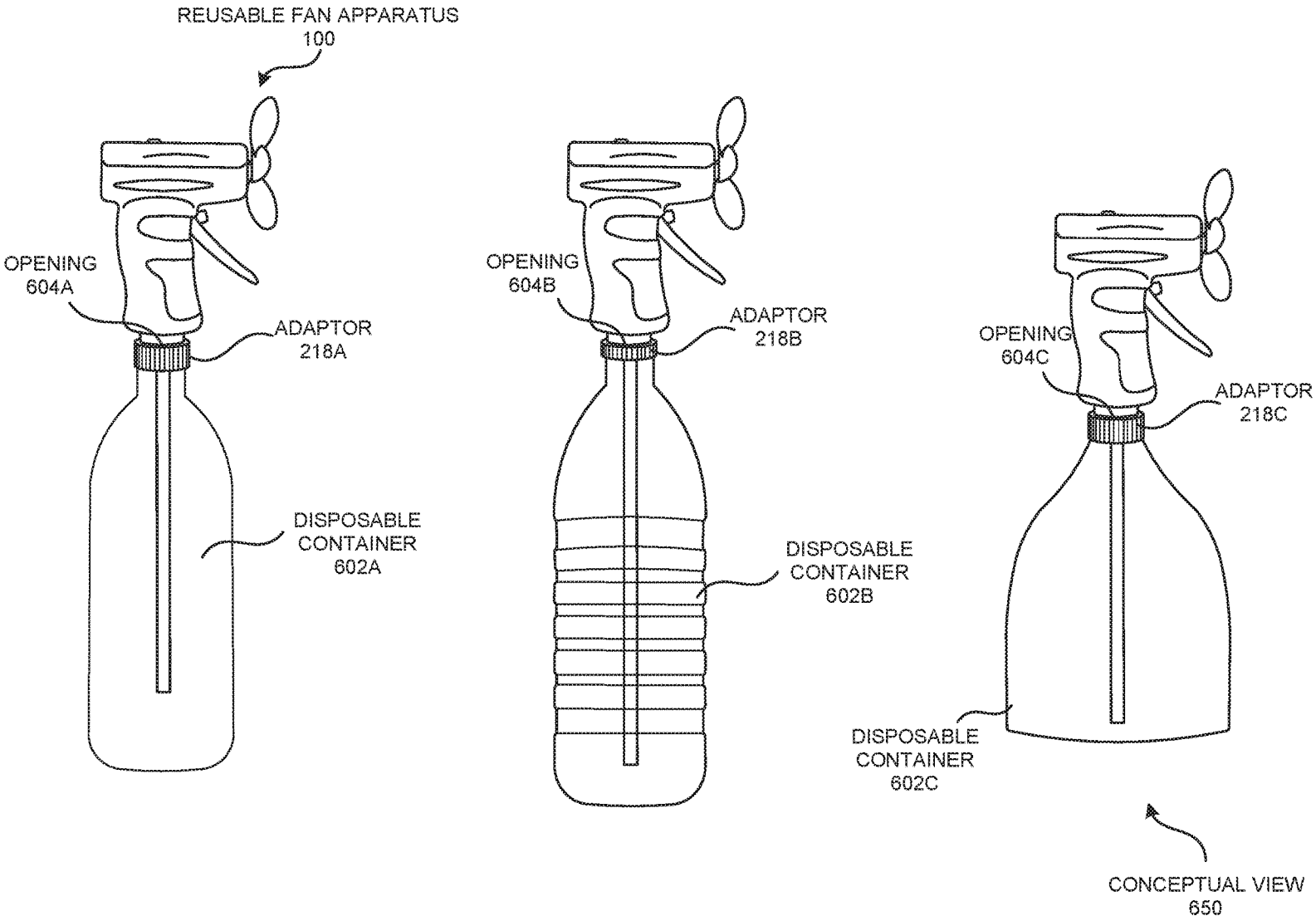
FIG. 6 is another conceptual view illustrating the reusable fan apparatus of FIG. 1 being coupled to a disposable container of various sizes through a modular attachment, adjustable to various opening sizes of the disposable container(s), according to one embodiment.

FIG. 6 is another conceptual view 650 illustrating the reusable fan apparatus 100 of FIG. 1 being coupled to a disposable container 110 (e.g., bottle, disposable container 602A, 602B, 602C) of various sizes through a modular attachment (e.g., adaptor 218A, 218B, 2018C), adjustable to various opening sizes (e.g., opening 604A, 604B, 604C) of the disposable container(s), according to one embodiment.

An example embodiment will now be described. John Doe may be a banker living in the desert city of Scottsdale in Arizona. Except for workdays, John may be a more of an outdoor person, who may enjoy hiking, bike riding, and/or even road trips. On weekends or holidays, John Doe may like to go for road trips, driving long distances from the city. During his travels, John may have to carry food and water along with him. During hot weather, John may require more water to replenish his body with cold and clean liquid. For this, John may have to buy pre-packaged water bottles sold in a retail store (e.g., a convenience store, a gas station, a grocery store). In addition, John may carry a misting fan for cooling himself in hot weather. John may have to refill his misting fan device frequently to provide cool air. However, John may find his misting fan to be too cumbersome to carry everywhere. In addition, John may have difficulty finding fresh, cool water for use in his misting fan device, making it unusable.

During one such road trip, John may have found the new reusable fan apparatus 100 as described in the various embodiments of FIGS. 1 to 6 couplable to a disposable container 110. John may have found this new reusable fan apparatus 100 to be very light and handy to use. John may now be able to couple his new reusable fan apparatus 100 to any readily available disposable water bottle (e.g., disposable container 110) using the coupling mechanism 108 as described in the various embodiments of FIGS. 1 to 6. John may now be able to lockingly engage his new reusable fan apparatus 100 to the disposable water bottle available at the retail store to help provide him misting of air using the water bottle. John may now be able to use any readily available fresh water bottle from a store and use that water supply to cool himself, making his travel pleasant one.

In addition, John may now be able to use his new reusable fan apparatus 100 on a disposable water bottle of any size by coupling through the adjustable coupling mechanism 402 and/or an adaptor 2 (e.g., plurality of adaptors 218) of the reusable fan apparatus 100 as described in the various embodiments of FIGS. 1 to 6. Furthermore, John may now be able to mount his new reusable fan apparatus 100 coupled to the disposable water bottle to the water bottle holder in his car while driving, making him happy and more enjoyable.

Although the present embodiments have been described with reference to specific example embodiments, it will be evident that various modifications and changes may be made to these embodiments without departing from the broader spirit and scope of the various embodiments. Accordingly, the specification and drawings are to be regarded in an illustrative rather than a restrictive sense.

A number of embodiments have been described. Nevertheless, it will be understood that various modifications may be made without departing from the spirit and scope of the claimed invention. In addition, other steps may be provided, or steps may be eliminated, from the described flows, and other components may be added to, or removed from, the described systems. Accordingly, other embodiments are within the scope of the following claims.

The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

The invention claimed is:

1. An adaptable spray fan comprising, a disposable container section formed of a polyethylene material to hold a potable liquid; and a reusable fan apparatus coupled to the disposable container section through an adjustable coupling mechanism of at least one of the reusable fan apparatus and a separate attachment couplable with the reusable fan apparatus to secure the reusable fan apparatus to the disposable container section at an opening of the disposable container section, the reusable fan apparatus comprising:

a misting head attached to an outer frame of a fan at a first end, the misting head comprising a misting nozzle and a controlling means in a form of a lever; and a core section forming an interior cavity, the core section extending from the misting head, wherein the controlling means in the form of the lever is configured to pump the potable liquid from the disposable container section through a conduit via the interior cavity to be expelled from the misting nozzle, the lever having another first end thereof protruding from the misting head toward another free second end of the lever such that a length of the lever is at an angle with respect to a length of the core section and a length of the conduit.

2. The adaptable spray fan of claim 1, wherein the reusable fan apparatus further comprises:

a calibration means to modify a size of the adjustable coupling mechanism to fasten with the opening of the disposable container section, wherein the opening of the disposable container section is circular in any one of a dimension between approximately ½ an inch and approximately 2 inches in diameter.

3. The adaptable spray fan of claim 1, wherein the adjustable coupling mechanism of the reusable fan apparatus comprises a one-click lock design to squeezably secure the reusable fan apparatus onto the opening of the disposable container section.

4. The adaptable spray fan of claim 1, wherein:

the separate attachment couplable with the reusable fan apparatus comprises an adapter to secure the reusable fan apparatus to the opening of the disposable container section through a male threaded end at a top portion of the adapter releasably engaged to a set of interrelated female threads at a second end of the reusable fan apparatus.

5. The adaptable spray fan of claim 1, wherein:

the reusable fan apparatus is configured such that the reusable fan apparatus remains upright when mounted on the disposable container section.

6. The adaptable spray fan of claim 1, wherein:

the reusable fan apparatus includes a set of batteries in a battery enclosure to activate a motor assembly coupled to the fan to provide a misting of the potable liquid, and the disposable container section engaged to the reusable fan apparatus is easily positionable on a water bottle holder of an automobile for usage while driving.

7. The adaptable spray fan of claim 1, wherein, the separate attachment couplable with the reusable fan apparatus is configured to use an adapter based on a size of the opening of the container.

8. A refrigerated merchandiser comprising:

a plurality of shelves of the refrigerated merchandiser to store a number of disposable liquid containers;

a transparent door of the refrigerated merchandiser through which the number of disposable liquid containers are viewable to customers at a retail store; and a set of reusable fan apparatuses advertised on a front face of the transparent door, wherein the set of reusable fan apparatuses is couplable with at least some of the disposable liquid containers stored in the plurality of shelves of the refrigerated merchandiser, and wherein each reusable fan apparatus of the set of reusable fan apparatuses is designed to be connectable to the at least some of the disposable liquid containers through an adjustable coupling mechanism of at least one of the each reusable fan apparatus and a separate attachment couplable with the each reusable fan apparatus to secure the each reusable fan apparatus to a disposable liquid container of the at least some of the disposable liquid containers at an opening of the disposable liquid container.

9. The refrigerated merchandiser of claim 8, further comprising:

a calibration means to modify a size of the adjustable coupling mechanism to fasten with the opening of the disposable liquid container.

10. The refrigerated merchandiser of claim 8, wherein:

the opening of the disposable liquid container is circular in any one of a dimension between approximately ½ an inch and approximately 2 inches in diameter.

11. The refrigerated merchandiser of claim 8, wherein:

the adjustable coupling mechanism is configured to allow the each reusable fan apparatus to be easily removable from the disposable container.

12. The refrigerated merchandiser of claim 8:

wherein the adjustable coupling mechanism is configured to squeezably secure the each reusable fan apparatus onto the opening of the disposable liquid container.

13. The refrigerated merchandiser of claim 12, wherein the adjustable coupling mechanism includes a one-click lock design to squeezably secure the each reusable fan apparatus onto the opening of the disposable liquid container.

14. The refrigerated merchandiser of claim 8, wherein, the separate attachment couplable with the each reusable fan apparatus includes an adapter to secure the each reusable fan apparatus to the opening of the disposable liquid container through a male threaded end at a top portion of the adapter releasably engaged to a set of interrelated female threads at a bottom portion of the each reusable fan apparatus.

15. An adaptable spray fan comprising, a reusable fan apparatus; and an adjustable coupling mechanism to enable coupling of the reusable fan apparatus to a disposable container section holding a potable liquid, the adjustable coupling mechanism being at least one of: part of the reusable fan and a separate attachment couplable with the reusable fan apparatus to secure the reusable fan apparatus to the disposable container section at an opening of the disposable container section, the reusable fan apparatus comprising:

a misting head attached to an outer frame of a fan at a first end, the misting head comprising a misting nozzle and a controlling means in a form of a lever; and a core section forming an interior cavity, the core section extending from the misting head, wherein the controlling means in the form of the lever is configured to pump the potable liquid from the disposable container section through a conduit via the interior cavity to be expelled from the misting nozzle, the lever having another first end thereof protruding from the misting head toward another free second end of the lever such that a length of the lever is at an angle with respect to a length of the core section and a length of the conduit.

16. The adaptable spray fan of claim 15, wherein the reusable fan apparatus further comprises:

a calibration means to modify a size of the adjustable coupling mechanism to fasten with the opening of the disposable container section.

17. The adaptable spray fan of claim 15, wherein:

the adjustable coupling mechanism of the reusable fan apparatus comprises a one-click lock design to squeezably secure the reusable fan apparatus onto the opening of the disposable container section.

18. The adaptable spray fan of claim 15, wherein:

the separate attachment couplable with the reusable fan apparatus comprises an adapter to secure the reusable fan apparatus to the opening of the disposable container section through a male threaded end at a top portion of the adapter releasably engaged to a set of interrelated female threads at a second end of the reusable fan apparatus.

19. The adaptable spray fan of claim 15, wherein:

the reusable fan apparatus is configured such that the reusable fan apparatus remains upright when mounted on the disposable container section.

20. The adaptable spray fan of claim 15, wherein:

the reusable fan apparatus includes a set of batteries in a battery enclosure to activate a motor assembly coupled to the fan to provide a misting of the potable liquid.

* * * * *